US005856728A

United States Patent [19]

Zimnicki et al.

[11] Patent Number: 5,856,728

[45] Date of Patent: Jan. 5, 1999

[54] POWER TRANSFORMER CIRCUIT WITH RESONATOR

[75] Inventors: Charles L. Zimnicki, Bartlett; John Mattson, Palatine, both of Ill.

[73] Assignee: Motorola Inc., Schaumburg, Ill.

[21] Appl. No.: 810,308

[22] Filed: Feb. 28, 1997

[51] Int. Cl.[6] ..... H05B 37/02

[52] U.S. Cl. ..... 315/209 PZ; 315/209 R; 315/276; 315/307; 333/187; 333/192

[58] Field of Search ..... 315/55, 62, 209 R, 315/209 PZ, 276, 291, 307, DIG. 7; 333/187, 188, 192; 310/316–321

[56] References Cited

U.S. PATENT DOCUMENTS

| | | | |
|---|---|---|---|
| 2,975,354 | 3/1961 | Rosen | 333/187 X |
| 3,676,806 | 7/1972 | Orchard et al. | 333/187 X |
| 3,764,848 | 10/1973 | Berlincourt | 315/55 |
| 4,801,837 | 1/1989 | Adams | 310/316 |
| 4,947,074 | 8/1990 | Suzuki | 310/316 |
| 5,204,576 | 4/1993 | Mitsuyasu | 310/317 |
| 5,208,505 | 5/1993 | Mitsuyasu | 310/317 |
| 5,394,048 | 2/1995 | Yamashita et al. | 310/316 |
| 5,446,429 | 8/1995 | Tanaka | 333/187 |
| 5,548,189 | 8/1996 | Williams | 315/224 |
| 5,612,597 | 3/1997 | Wood | 315/293 |
| 5,644,273 | 7/1997 | Kaida et al. | 333/187 |

OTHER PUBLICATIONS

"Crystal Filters; Design, Manufacture, and Application," Robert G. Kinsman, Motorola, Inc.; Wiley–Interscience Publication 1986 pp. 64–67.

*Primary Examiner*—Don Wong
*Assistant Examiner*—Haissa Philogene
*Attorney, Agent, or Firm*—Kenneth D. Labudda; Gary J. Cunningham

[57] ABSTRACT

A power transformer circuit (100) includes a capacitor (120) and a resonator (140). The resonator (140) is coupled in series with the capacitor (120) and is operable to provide a substantially inductive impedance between its terminals (142,144). Resonator (140) is preferably implemented as a piezoelectric lithium niobate resonator that is operated in a thickness-shear mode. In a preferred embodiment, power transformer circuit (100) is employed as a series resonant output circuit in an electronic ballast (500) for powering at least one gas discharge lamp (30).

31 Claims, 4 Drawing Sheets

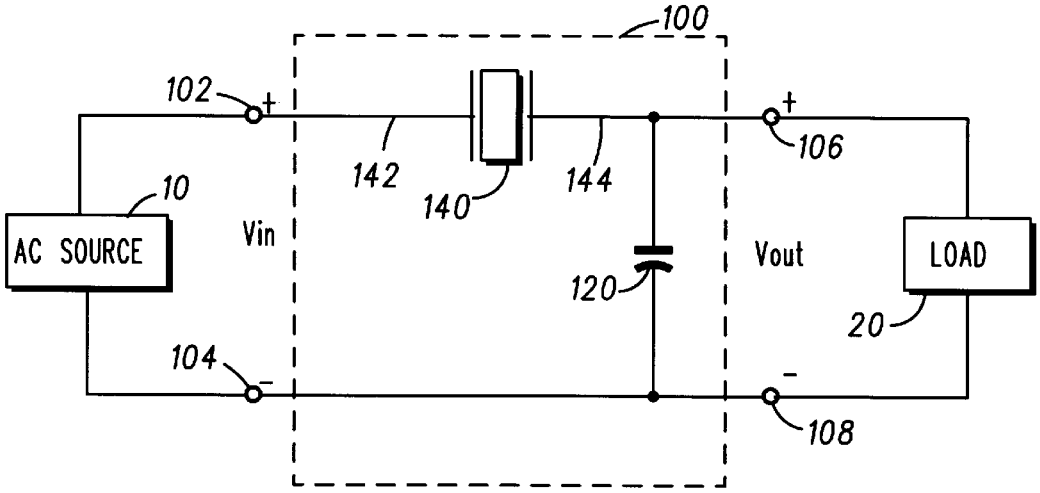
FIG.1
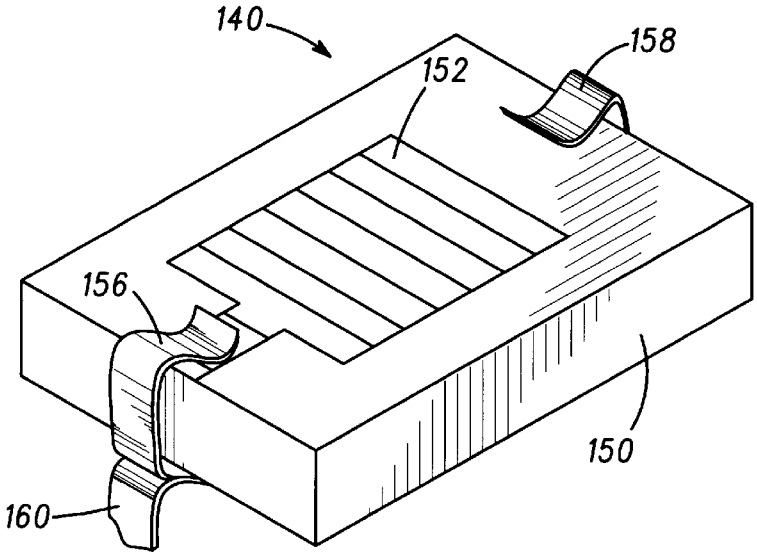
FIG.2
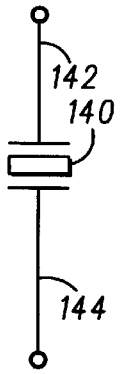
RESONATOR SYMBOL
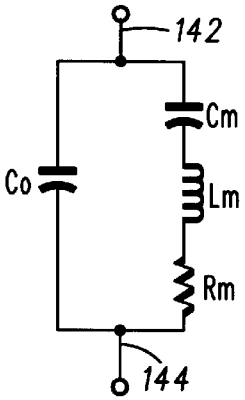
RESONATOR EQUIVALENT CIRCUIT
FIG.3A FIG.3B

POWER TRANSFORMER CIRCUIT WITH RESONATOR

FIELD OF THE INVENTION

The present invention relates to the general subject of electronic circuits and, in particular, to a power transformer circuit with a resonator.

BACKGROUND OF THE INVENTION

Several types of electronic circuits employ a power transformer circuit for providing voltage gain, impedance matching, and current limiting. Power transformer circuits usually require an inductive element that is typically realized using a conventional magnetic inductor.

Conventional magnetic inductors are physically large, heavy devices that are both costly to construct and difficult to automate. Magnetic inductors are also among the most ill-behaved of electrical components with regard to parameter tolerances and nonlinear effects, the latter being particularly troublesome in high frequency applications. Due to winding resistance and core characteristics, magnetic inductors dissipate significant amounts of electrical power in the form of heat. The heat produced by magnetic inductors not only detracts from circuit energy efficiency, but also requires that other circuit components be selected with high temperature ratings in order to maintain circuit reliability.

Further, because of these dissipative factors, magnetic inductors have a relatively low "quality factor" (i.e., "Q"), Accordingly, power transformer circuits that employ magnetic inductors have limited voltage gain capabilities. As a consequence of these shortcomings of magnetic inductors, the resulting power transformer circuit tends to be physically large and costly, prone to nonlinear effects and considerable variations in key parameters, constrained in voltage gain capability, and significantly sub-optimal with regard to energy efficiency and reliability.

In recent years, a number of efforts have been made to apply certain electromechanical devices, such as piezoelectric transformers (e.g., Rosen bar transformers), to power supplies and other types of energy transfer circuits. While it has been realized that these devices are, under certain modes of operation, considerably more energy efficient and capable of providing higher voltage gain than conventional magnetic inductors, most efforts have been limited to low power circuits for transferring relatively small amounts of power. Further, most existing approaches require considerable complexity in the physical structure of the devices themselves and/or additional control circuitry in order to operate the devices in an efficient manner.

It is therefore apparent that a need exists for a power transformer circuit that provides efficient transfer of a considerable amount of electrical power, that is smaller in size, lighter in weight, and less thermally dissipative than circuits using ordinary magnetic inductors, that provides high voltage gain, that employs devices with relatively simple physical structures, and that does not require complicated control circuitry. Such a power transformer circuit would represent a considerable advance over the prior art.

BRIEF DESCRIPTION OF THE DRAWINGS

FIG. 1 describes a power transformer circuit that includes a simple resonator.

FIG. 2 illustrates one possible physical structure for a piezoelectric resonator.

FIG. 3A shows a conventional schematic symbol for a resonator.

FIG. 3B describes an electrical equivalent circuit for a piezoelectric resonator.

DETAILED DESCRIPTION OF THE PREFERRED EMBODIMENTS

Figure 4:
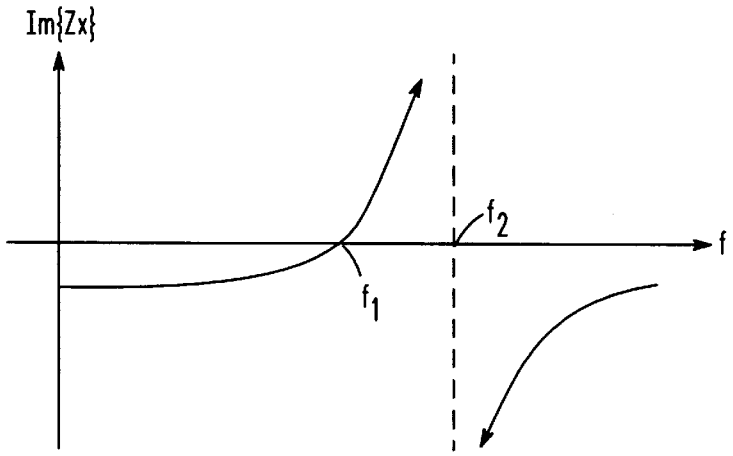
FIG. 4 is a sample plot of reactive impedance versus operating frequency for a piezoelectric resonator.

FIG. 1 describes a power transformer circuit 100 comprising first and second input connections 102,104, first and second output connections 106,108, a first capacitor 120, and a resonator 140. Input connections 102,104 are adapted for receiving a source of alternating current 10, and first and second output connections 106,108 are adapted for coupling to a load 20. First capacitor 120 is coupled between first and second output connections 106,108. Resonator 140 has a first terminal 142 that is coupled to first input terminal 102, and a second terminal 144 that is coupled to first output terminal 106. During operation of power transformer circuit 100, resonator 140 provides a substantially inductive equivalent impedance between its first and second terminals 142,144. That is, when excited at an appropriate frequency by AC source 10, resonator 140 provides the approximate terminal behavior of an inductor.

First capacitor 120 may be realized by way of an ordinary discrete capacitor or, at very high operating frequencies for which only a relatively small capacitance is needed, using embedded capacitance methods by which, for example, adjacent traces on a printed-circuit board are designed to provide a desired stray capacitance.

Resonator 140 can be implemented using any of a number of piezoelectric or ferroelectric materials that have high coupling coefficients and appropriate mechanical properties, examples of which are lithium niobate ($LiNbO_3$), lead zirconate titanate (PZT), or lithium tantalate ($LiTaO_3$). In a preferred embodiment of power transformer circuit 100, resonator 140 is implemented as a piezoelectric lithium niobate resonator and power transformer circuit 100 is operable to efficiently transfer at least 0.5 watts of power to load 20. More generally, based on selection of a suitable material (such as lithium niobate) and an appropriate operating frequency (such as 100 kilohertz or greater) for resonator 140, power transformer circuit 100 is capable of supplying to load 20 an amount of electrical power that is at least ten times greater than the amount of power that it dissipates internally.

Turning now to FIG. 2, a preferred physical structure for resonator 140 is illustrated. The resonator 140 includes a crystal 150 having metalized electrode regions 152 on its top and bottom surfaces; for the sake of clarity, only one metalized electrode region, located on the top surface of crystal 150, is shown in FIG. 2. Mounting structures 156,158 provide electrical contact between each lead 160 and its corresponding electrode 152. It should be appreciated that the geometries of crystal 150, electrodes 152, and mounting structures 156,158 are not limited to those shown in FIG. 2, but can be modified in various ways to provide enhanced electrical and mechanical performance of resonator 140. For example, crystal 150 may be disk-shaped with contoured, as opposed to flat, surfaces. Various other aspects relating to the fabrication and composition of resonator 140 are widely known by those skilled in the art of resonators and related devices.

Whereas a conventional magnetic inductor stores electrical energy in a magnetic field, resonator 140 stores electrical energy in the form of mechanical vibrations in crystal 150. These vibrations impose a degree of stress upon the crystal 150 that, for a given size and type of material, limit the amount of energy that can be efficiently stored/transferred by resonator 140. Accordingly, in order to achieve a high degree of energy storage/transfer for a given volume of material in crystal 150, it is preferred that resonator 140 be operated in a "thickness-shear" mode. In physical terms, operation in the thickness-shear mode corresponds to crystal 150 vibrating in such a way that the resultant shearing forces in crystal 150 are directed along the axes parallel to the planes of metalized regions 152.

FIG. 3A shows a conventional schematic symbol for a resonator.

FIG. 3B shows an electrical equivalent circuit for resonator 140. FIG. 4 is a sample plot of the imaginary, or reactive, portion of the terminal impedance, Zx, of resonator 140 as a function of operating frequency, f. As described in FIG. 4, when operated within the frequency range $f_1<f<f_2$, the impedance, $Z_X$, of resonator 140 has a positive reactive component and is therefore approximately inductive. Depending on the type of material used for crystal 150, the inductive region $f_1<f<f_2$ may include frequencies as low as 100 kilohertz and as high as several megahertz or greater.

Turning back to FIG. 1, when resonator 140 is operated in the inductive region, first capacitor 120 and resonator 140 together function as a series resonant LC circuit in which capacitor 120 has a capacitance, C, and resonator 140 has an equivalent inductance, L. Because the inductive impedance of resonator 140 is accompanied by a resistive component that is very low in comparison with that of a magnetic inductor, resonator 140 has an extremely high quality factor. Thus, provided that the impedance of load 20 is not extremely low relative to that of resonator 140, power transformer 100 provides a high level of voltage gain ($V_{OUT}/V_{IN}$) when operated at or near the series resonant frequency of L and C. Additionally, and in contrast to magnetic inductors, the inductance of resonator 140 is substantially linear in that L remains essentially constant over a wide range of excitation applied to resonator 140. Thus, resonator 140 closely approximates an ideal (i.e., lossless and linear) inductor. In addition to providing high voltage gain, power transformer circuit 100 also serves as a current source for limiting the amount of current delivered to load 20. Power transformer circuit 100 is therefore particularly suitable for supplying power to gas discharge lamps, since high voltage is required in order to ignite the lamps and a current-limiting "ballast" circuit is needed in order to control the amount of current delivered to the lamps and thereby prevent the lamps from otherwise certain self-destruction.

Figure 5:
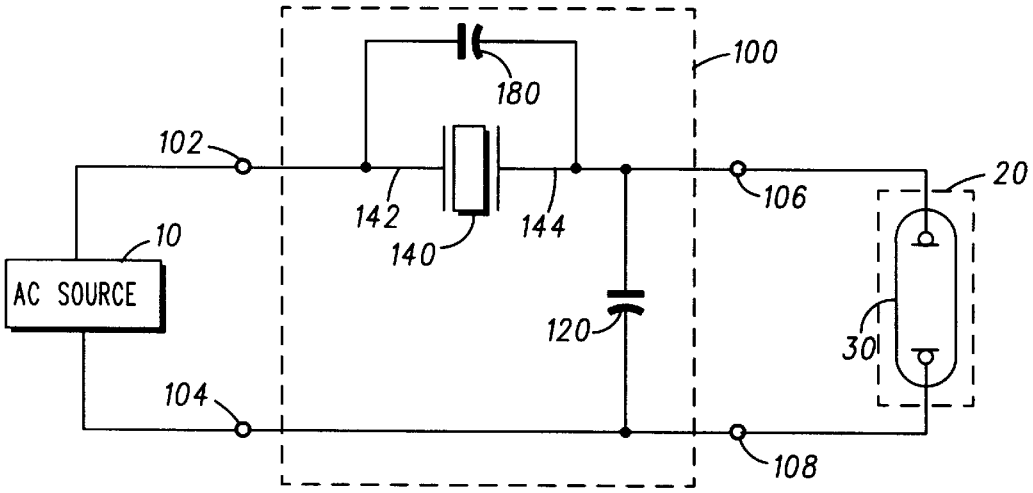
FIG. 5 describes a power transformer circuit that includes a tuning capacitor in parallel with the resonator.

As shown in FIG. 5, power transformer 100 optionally includes a second capacitor 180 that is coupled in parallel with resonator 140 between first input connection 102 and first output connection 106. Second capacitor 180 serves as a tuning capacitor for effectively modifying the apparent equivalent impedance of resonator 140. More specifically, referring back to FIGS. 3 and 4, capacitor 180 effectively augments the internal static capacitance $C_0$ of resonator 140 and thereby effects a leftward shift in the impedance curve of resonator 140, thus allowing operation of power transformer circuit 100 at a lower frequency and without necessitating use of a different or more complex resonator.

Figure 6:
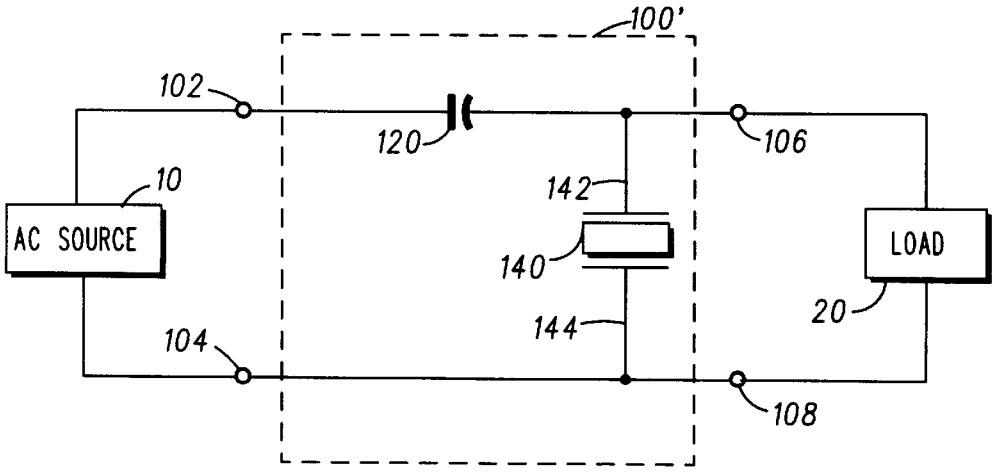
FIG. 6 describes an alternative power transformer circuit.

In an alternative embodiment of power transformer circuit 100, as shown in FIG. 6, the relative connections of resonator 140 and first capacitor 120 are interchanged from that which is shown in FIG. 1. Specifically, first capacitor 120 is coupled between first input connection 102 and first output connection 106, and resonator 140 is coupled between the first and second output connections 106,108. In comparison with power transformer circuit 100, power transformer circuit 100' provides enhanced voltage gain at higher frequencies and is useful for those applications in which load current limiting is not required.

Figure 7:
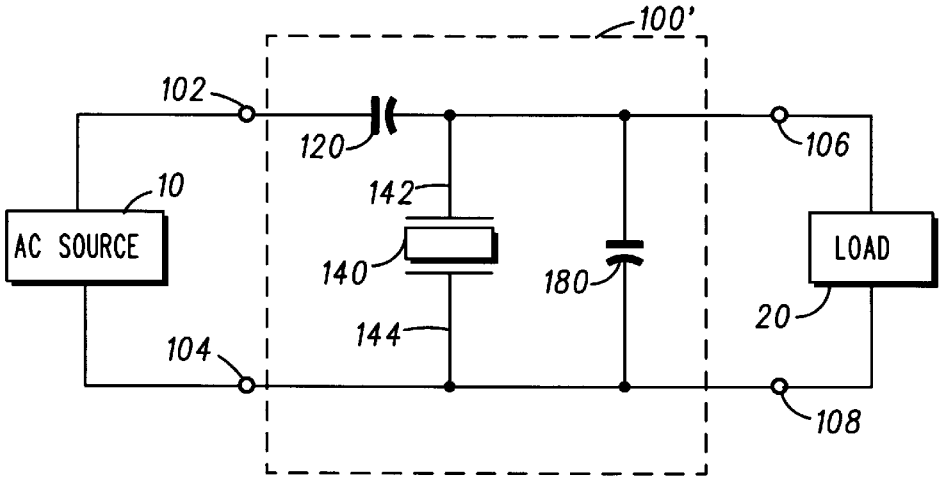
FIG. 7 describes the power transformer circuit of FIG. 6 with a tuning capacitor placed in parallel with the resonator.

As shown in FIG. 7, a second capacitor 180 may be placed in parallel with resonator 140 between first and second output connections 106,108. As discussed previously with regard to FIG. 5, capacitor 180 serves as a tuning capacitor that effectively modifies the impedance characteristics of resonator 140 to allow for a lower operating frequency of power transformer circuit 100'.

Figure 8:
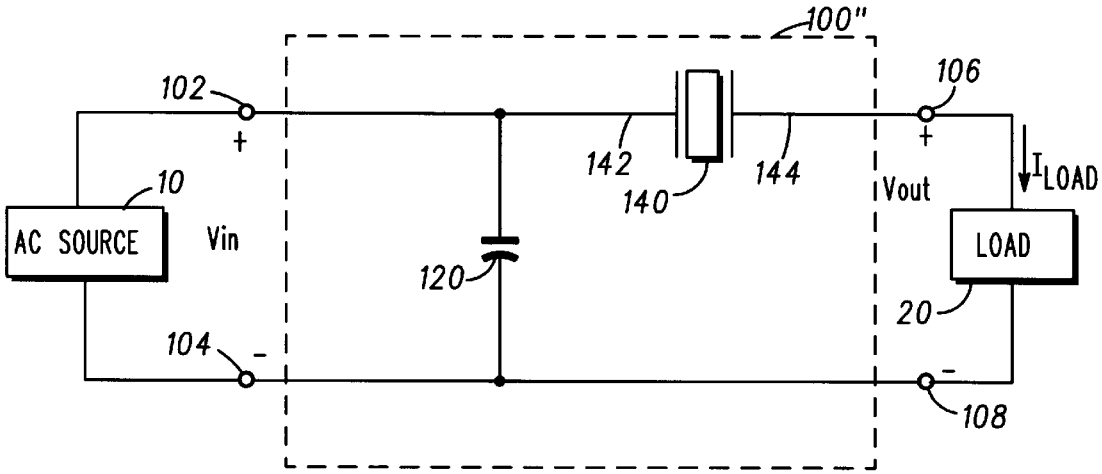
FIG. 8 describes a power transformer circuit configured for use as a voltage step-down circuit.

Turning now to FIG. 8, power transformer circuit 100 can also be used in the reverse direction to provide an alternative power transformer circuit 100" that functions as a step-down transformer (i.e., $V_{OUT}/V_{IN}<1$) and that provides a magnitude limited current, $I_{LOAD}$, to load 40. Specifically, first capacitor 120 is coupled between first and second input connections 102,104, and resonator 140 is coupled between first input connection 102 and first output connection 106. Power transformer circuit 100" is suitable for use in systems such as battery chargers for which a low output voltage and load current limiting are required.

Figure 9:
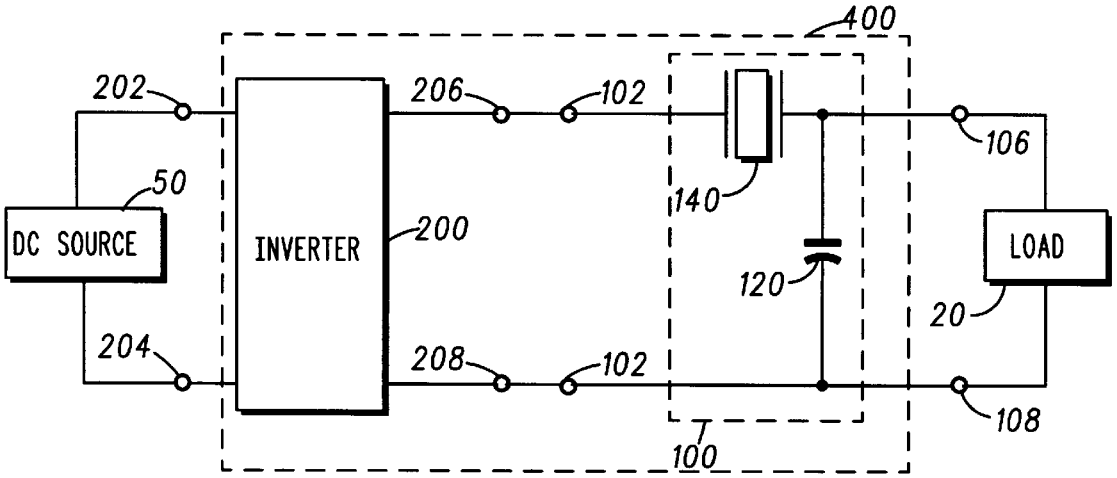
FIG. 9 is a partial block diagram schematic of an electronic power supply circuit.

An electronic power supply circuit 400 that employs power transformer circuit 100 is described in FIG. 9. Power supply 400 includes an inverter 200 having a pair of input terminals 202,204 that are adapted to receive a source of direct current 50, and a pair of output terminals 206,208 that are coupled to the input connections 102,104 of power transformer circuit 100. Inverter 200, which functions as a DC-to-AC converter, accepts a direct current (DC) input voltage from DC source 50 and provides a periodic (AC) output voltage to power transformer circuit 100.

Figure 10:
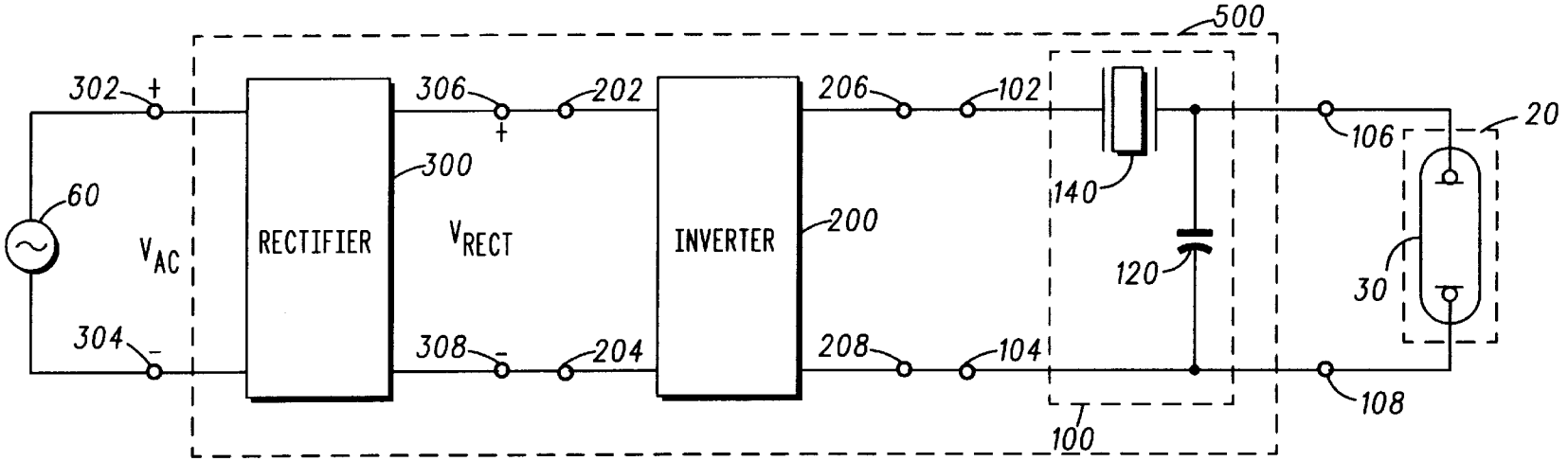
FIG. 10 is a partial block diagram schematic of an electronic power supply circuit that is adapted for powering a gas discharge lamp.

Turning now to FIG. 10, power transformer circuit 100 is preferably employed as a series resonant output circuit in an electronic ballast 500 for powering at least one gas discharge lamp 30. Ballast 500 includes a rectifier circuit 300 having a pair of input connections 302,304 that are adapted to receive a source of conventional alternating current 60, and a pair of output connections 306,308 that are coupled to the input terminals 202,204 of inverter 200. Rectifier 300 accepts a sinusoidal low frequency voltage, $V_{AC}$, from AC source 60 and supplies a unidirectional voltage, $V_{RECT}$, to inverter 200.

Figure 11:
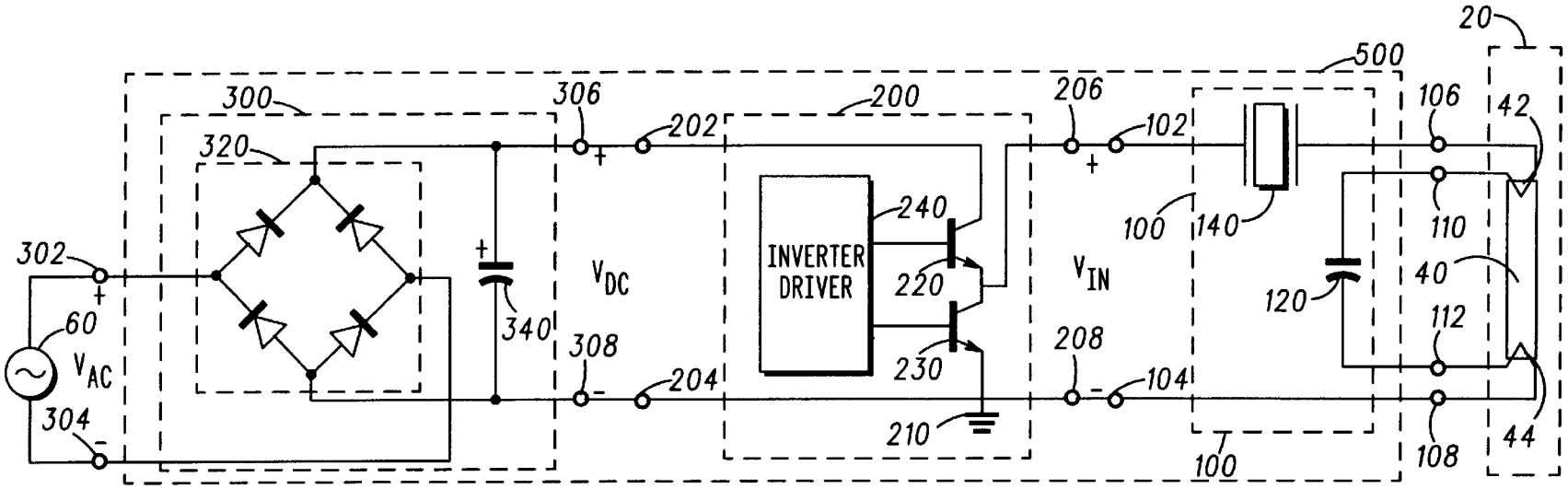
FIG. 11 is a circuit schematic of an electronic ballast for powering fluorescent lamps.

In a preferred embodiment of ballast 500, as illustrated in FIG. 11, rectifier circuit 300 comprises a full-wave diode bridge 320 and a bulk capacitor 340. Bulk capacitor 340 filters the full-wave rectified AC voltage provided by diode bridge 320 and provides a substantially direct current voltage, $V_{DC}$, to inverter 200.

As shown in FIG. 11, inverter 200 is preferably implemented as a half-bridge type inverter that includes a first inverter switch 220 coupled between first input terminal 202 and first output terminal 206, and a second inverter switch 230 coupled between first output terminal 206 and circuit ground node 210. Although shown as bipolar junction transistors, inverter switches 220,230 may be implemented using any of a number of suitable power switching devices, such as field-effect transistors. Inverter 200 also includes an inverter driver circuit 240 that is coupled to the first and second inverter switches 220,230, and that is operable to commutate inverter switches 220,230 in a substantially complementary fashion and at a high frequency rate at or near the series resonant frequency of capacitor 120 and resonator 140. Stated another way, inverter driver circuit 240 controls the conduction of inverter switches 220,230 so that when switch 220 is on, switch 230 is off, and vice versa. Inverter driver circuit 240 may be implemented as a dedicated driver circuit that includes, for example, an integrated circuit (IC) such as the IR2151 high-side driver IC manufactured by International Rectifier. Alternatively, inverter driver circuit 240 may be realized using any of a number of well known self-oscillating arrangements in which feedback from power transformer circuit 100 is used to provide switching of inverter switches 230,240.

In a conventional half-bridge inverter, a direct current (DC) blocking capacitor is typically required in order to provide a symmetrical square-wave output voltage, $V_{IN}$, between inverter output terminals 206,208. In ballast 500 of FIG. 11, this capacitance is implicitly provided by resonator 140. That is, referring back to the equivalent circuit shown in FIG. 3, the internal motional capacitance, $C_m$, of resonator 140 provides the functionality of a DC blocking capacitor. Thus, power transformer circuit 100 has the added benefit of eliminating the customary need for a separate DC blocking capacitor in half-bridge inverter 200.

Referring again to FIG. 11, power transformer circuit 100 additionally includes third and fourth output connections 110,112. Specifically, third output connection 110 is coupled to first output connection 104 through a first filament 42 of fluorescent lamp 40, and fourth output connection 112 is coupled to second output connection 106 through a second filament 44 of fluorescent lamp 40. Capacitor 120 is coupled between third and fourth output connections 110,112. In this configuration, heating current is provided to the lamp filaments 42,44 through capacitor 120. In the event that one or both filaments become open, or if the lamp 40 is either removed or is not properly connected to output connections 106,108,110,112, capacitor 120 is then automatically disconnected from the rest of the circuit. Consequently, large and potentially damaging currents are prevented from flowing in power transformer circuit 100. The recited connections thus provide a type of automatic protection in the event of lamp failure or removal.

An experimental ballast configured substantially as shown in FIG. 11 and designed for powering one 13 watt compact fluorescent lamp (CFL) was built and tested. The ballast employed a lithium niobate resonator operated at around 2 megahertz, and provided power to the lamp with an energy efficiency of at least 90 to 95 percent. The crystal of resonator 140 measured a mere 9 millimeters wide by 11 millimeters long by 1 millimeter thick, making resonator 140 at least several times smaller and lighter than a comparable magnetic inductor. Because of its very small size, as well as its high efficiency and low power dissipation, power transformer circuit 100 is particularly well suited for use in "integral" compact fluorescent products in which the entire ballast circuit is housed within the socket portion of the lamp assembly.

Power transformer circuit 100, as well as its alternative embodiments and applications described herein, provides a number of significant advantages over existing circuits that use either magnetic inductors or conventional piezoelectric transformers. Power transformer circuit 100 employs a structurally uncomplicated resonator to provide an equivalent inductance that closely approximates an ideal inductor. Consequently, power transformer circuit 100 provides significantly higher voltage gain and lower power dissipation than prior art circuits that use magnetic inductors. Related benefits are minimization of undesirable (and often unpredictable) non-linear effects, particularly at high operating frequencies, as well as reduced variation in circuit parameters. Furthermore, power transformer circuit 100 has an uncomplicated structure that obviates the need for dedicated circuitry for controlling the resonator. The result is a cost-effective power transformer circuit that is applicable to power supplies, discharge lamp ballasts, and other power electronic circuits and systems for which high energy efficiency, small size, and low weight are important considerations.

Although the present invention has been described with reference to certain preferred embodiments, numerous modifications and variations can be made by those skilled in the art without departing from the novel spirit and scope of this invention.

What is claimed is:

1. A power transformer circuit, comprising:

first and second input connections adapted to receive a source of alternating current;

first and second output connections adapted for coupling to a load, the second output connection being coupled to the second input connection;

a first capacitor coupled between the first and second output connections; and a two-terminal resonator having a first terminal coupled to the first input connection, and a second terminal coupled to the first output connection, wherein the source of alternating current has a frequency at which the resonator is operable to provide a substantially inductive impedance between its first and second terminals.

2. The power transformer circuit of claim 1, wherein the resonator is at least one of: a lithium niobate resonator, a lead zirconate titanate resonator, and a lithium tantalate resonator.

3. The power transformer circuit of claim 1, wherein the resonator is operated in a thickness-shear mode.

4. The power transformer circuit of claim 1, wherein the source of alternating current has a frequency greater than 100 kilohertz.

5. The power transformer circuit of claim 1, wherein the power transformer circuit is operable to transfer at least 0.5 watts of power to the load.

6. The power transformer circuit of claim 1, wherein the power transformer circuit is operable to supply to the load an amount of power that is at least ten times greater than the amount of power that is internally dissipated by the power transformer circuit.

7. The power transformer circuit of claim 1, further comprising a second capacitor coupled between the first input connection and the first output connection.

8. The power transformer circuit of claim 1, wherein the load comprises at least one gas discharge lamp.

9. A power transformer circuit, comprising:

first and second input connections adapted to receive a source of alternating current;

first and second output connections adapted for coupling to a load, the second output connection being coupled to the second input connection;

a first capacitor coupled between the first input connection and the first output connection; and a two-terminal resonator having a first terminal coupled to the first output connection, and a second terminal coupled to the second output connection, wherein the source of alternating current has a predetermined frequency at which the resonator is operable to provide a substantially inductive impedance between its first and second terminals.

10. The power transformer circuit of claim 9, wherein the resonator is at least one of: a lithium niobate resonator, a lead zirconate titanate resonator, and a lithium tantalate resonator.

11. The power transformer circuit of claim 9, wherein the resonator is operated in a thickness-shear mode.

12. The power transformer circuit of claim 9, wherein the source of alternating current has a frequency greater than 100 kilohertz.

13. The power transformer circuit of claim 9, wherein the power transformer circuit is operable to transfer at least 0.5 watts of power to the load.

14. The power transformer circuit of claim 9, wherein the power transformer circuit is operable to supply to the load an amount of power that is at least ten times greater than the amount of power that is internally dissipated by the power transformer circuit.

15. The power transformer circuit of claim 9, further comprising a second capacitor coupled between the first and second output connections.

16. A power transformer circuit, comprising:

first and second input connections adapted to receive a source of alternating current;

first and second output connections adapted for coupling to a load, the second output connection being coupled to the second input connection;

a first capacitor coupled between the first and second input connections; and a two-terminal resonator having a first terminal coupled to the first input connection, and a second terminal coupled to the first output connection, wherein the source of alternating current has a predetermined frequency at which the resonator is operable to provide a substantially inductive impedance between its first and second terminals.

17. The power transformer circuit of claim 16, wherein the resonator is at least one of: a lithium niobate resonator, a lead zirconate titanate resonator, and a lithium tantalate resonator.

18. The power transformer circuit of claim 16, wherein the resonator is operated in a thickness-shear mode.

19. The power transformer circuit of claim 16, wherein the source of alternating current has a frequency greater than 100 kilohertz.

20. The power transformer circuit of claim 16, wherein the power transformer circuit is operable to transfer at least 0.5 watts of power to the load.

21. The power transformer circuit of claim 16, wherein the power transformer circuit is operable to supply to the load an amount of power that is at least ten times greater than the amount of power internally dissipated by the power transformer circuit.

22. The power transformer circuit of claim 16, further comprising a second capacitor coupled between the first input connection and the first output connection.

23. An electronic power supply circuit, comprising:

a half-bridge type inverter having a pair of input terminals that are adapted to receive a source of direct current, and a pair of output terminals, wherein the inverter is operable to provide across the output terminals a periodic voltage having a frequency greater than 100 kilohertz; and a power transformer circuit, comprising:

first and second input connections coupled to the inverter output terminals;

first and second output connections adapted for coupling to a load, the second output connection being coupled to the second input connection;

a first capacitor coupled between the first and second output connections;

a two-terminal resonator having a first terminal coupled to the first input connection, and a second terminal coupled to the first output connection, the resonator being operable to provide a substantially inductive impedance between its first and second terminals; and wherein the power transformer circuit is operable to supply to the load an amount of electrical power that is at least ten times greater than the amount of power that is internally dissipated by the power transformer circuit.

24. The electronic power supply of claim 23, wherein the resonator is at least one of: a lithium niobate resonator, a lead zirconate titanate resonator, and a lithium tantalate resonator.

25. The electronic power supply of claim 23, wherein the resonator is a lithium niobate piezoelectric resonator operated in a thickness-shear mode.

26. The electronic power supply of claim 23, further comprising a rectifier circuit having a pair of input connections and a pair of output connections, wherein the rectifier circuit input connections are adapted to receive a source of sinusoidal alternating current, and the rectifier circuit output connections are coupled to the inverter input terminals.

27. The electronic power supply of claim 23, wherein the inverter is a half-bridge type inverter, comprising:

a first inverter switch coupled between a first input terminal and a first output terminal of the inverter;

a second inverter switch coupled between a first output terminal of the inverter and a circuit ground node, the circuit ground node being coupled to a second input terminal of the inverter; and an inverter driver circuit coupled to the first and second inverter switches and operable to commutate the inverter switches in a substantially complementary fashion.

28. The electronic power supply of claim 23, wherein the power transformer circuit further comprises a second capacitor coupled between the first input connection and the first output connection of the power transformer circuit.

29. The electronic power supply of claim 23, wherein the load comprises at least one gas discharge lamp.

30. An electronic ballast for powering at least one fluorescent lamp, comprising:

a rectifier circuit having a pair of input connections and a pair of output connections, the rectifier circuit input connections being adapted to receive a source of sinusoidal alternating current;

a half-bridge inverter comprising:

a pair of input terminals and a pair of output terminals, the input terminals being coupled to the rectifier circuit output connections;

a first inverter switch coupled between a first input terminal and a first output terminal of the inverter;

a second inverter switch coupled between the first output terminal and a circuit ground node, the circuit ground node being coupled to a second input terminal of the inverter; and an inverter driver circuit coupled to the first and second inverter switches and operable to commutate the inverter switches in a substantially complementary fashion; and a power transformer circuit, comprising:

first and second input connections coupled to the inverter output terminals;

first, second, third, and fourth output connections adapted for coupling to at least one fluorescent lamp, wherein the first output connection is coupleable to the third output connection through a first filament of the fluorescent lamp, the second output connection is coupleable to the fourth output connection through a second filament of the fluorescent lamp, and the second output connection is coupled to the second input connection;

a capacitor coupled between the third and fourth output connections;

a lithium niobate resonator having a first terminal coupled to the first input connection, and a second terminal coupled to the first output connection, wherein the resonator is operated in a thickness-shear mode and is operable to provide a substantially inductive impedance between its first and second terminals; and wherein the power transformer circuit is operable to supply to the fluorescent lamp an amount of electrical power that is at least ten times greater than the amount of power that is internally dissipated by the power transformer circuit.

31. An electronic ballast for powering at least one fluorescent lamp, comprising:

a rectifier circuit having a pair of input connections and a pair of output connections, the rectifier circuit output connections being adapted to receive a source of sinusoidal alternating current;

a half-bridge inverter, comprising:

a pair of input terminals and a pair of output terminals, the input terminals being coupled to the rectifier circuit output connections;

a first inverter switch coupled between a first input terminal and a first output terminal of the inverter;

a second inverter switch coupled between the first output terminal and a circuit ground node, the circuit ground node being coupled to a second input terminal of the inverter; and an inverter driver circuit coupled to the first and second inverter switches and operable to commutate the inverter switches in a substantially complementary fashion; and a power transformer circuit, comprising:

first and second input connections coupled to the inverter output terminals;

first, second, third, and fourth output connections adapted for coupling to at least one fluorescent lamp, wherein the first output connection is coupleable to the third output connection through a first filament of the fluorescent lamp, the second output connection is coupleable to the fourth output connection through a second filament of the fluorescent lamp, and the second output connection is coupled to the second input connection;

a capacitor coupled between the third and fourth output connections;

a resonator having a first terminal coupled to the first input connection, and a second terminal coupled to the first output connection, wherein the resonator is operable to provide a substantially inductive impedance between its first and second terminals; and wherein the power transformer circuit is operable to supply to the fluorescent lamp an amount of electrical power that is at least ten times greater than the amount of power that is internally dissipated by the power transformer circuit.

* * * * *